United States Patent [19]

Hovartos et al.

[11] 4,183,470

[45] Jan. 15, 1980

[54] WATER ACTUATED DISPOSER

[75] Inventors: Theodore Hovartos, Van Nuys; Walter O. Engel, Los Angeles, both of Calif.

[73] Assignee: Lorraine Linder, North Hollywood, Calif.

[21] Appl. No.: 892,474

[22] Filed: Apr. 3, 1978

[51] Int. Cl.[2] ..... B02C 18/42

[52] U.S. Cl. ..... 241/46 B; 241/46.11; 241/46.17

[58] Field of Search ..... 241/46 R, 46 A, 46 B, 241/46.11, 46.17, 257 G

[56] References Cited

U.S. PATENT DOCUMENTS

| | | | |
|---|---|---|---|
| 2,577,152 | 12/1951 | Powers | 241/257 G |
| 2,604,633 | 7/1952 | McPherson | 241/46.11 X |
| 2,832,546 | 4/1958 | Sprague | 241/46.11 |
| 2,940,677 | 6/1960 | Jordan | 241/257 G |
| 3,700,178 | 10/1972 | Verley | 241/46 B |

*Primary Examiner*—Robert L. Spicer, Jr.
*Attorney, Agent, or Firm*—W. Jacquet Gribble

[57] ABSTRACT

A water actuated garbage disposer has an impeller chamber with an impeller having a plurality of fin-like projections on its periphery. A water jet at the generally planar faces of each of the projections imparts the driving force to the impeller. An outlet duct is disposed substantially in line with the water jet stream, thereby facilitating the removal of spent water from the impeller chamber. The impeller is coupled to an abrasion disc having a plurality of implanted abrading blades which may be arcuate, radial or chordal. When radial the blades may be centrifugally operated. The impeller is balanced and weighted to obtain a pre-selected moment of inertia and mass in order to optimize the operation of the disposer. The disposer has upper, central and lower separable chambers for ease in maintenance and assembly, the lower chamber containing the impeller. The upper chamber may contain abrading blades secured to interior walls.

31 Claims, 19 Drawing Figures

18
12

33
25
40
26
10
28
28
20
39
39
36
41
70
48
40

26
56
24
54
62
25
52
74
54
16
20
22
54
52

Fig. 14.
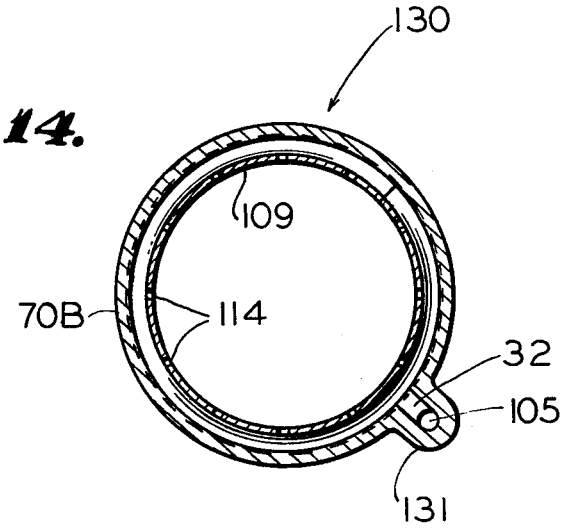
Fig. 16.
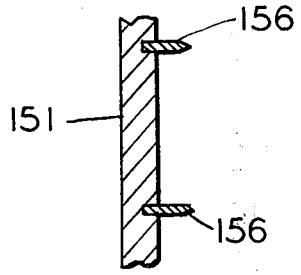
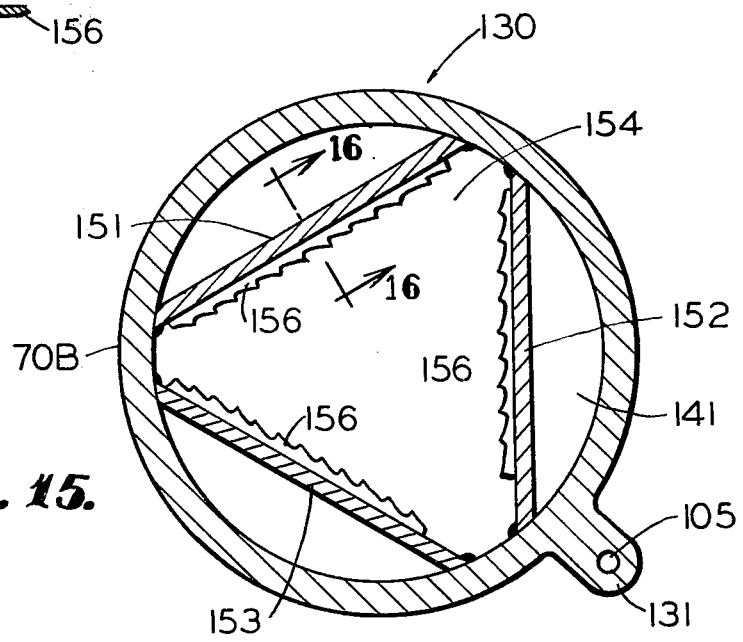
Fig. 15.

WATER ACTUATED DISPOSER

BACKGROUND OF THE INVENTION

The present invention relates generally to the field of industrial and household waste disposers and more particularly to water powered garbage waste disposers.

Prior art water powered or actuated waste disposers employ both a reciprocating and rotary motion to drive the active elements of the disposer. See for example, U.S. Pat. No. 3,700,178 and U.S. Pat. No. 3,788,564. However, prior art hydraulically driven disposers have employed impellers which have either been of a close vane or chamber type such as in U.S. Pat. No. 3,044,722 or have employed open paddle wheels such as in U.S. Pat. No 2,832,564. The closed chamber type impellers are characterized by a multiplicity of parts which have a tendency to stick, wear and degrade, thereby giving rise to a high frictional force and consuming a substantial fraction of the driving power to a mere operation of the impeller. Prior art open paddle wheel type impellers typically exhibit low power and have a tendency to stick or stop in a position wherein the driving water jet is not directly impinging upon an impeller paddle.

Centrifugally operated blade elements, used for grinding the waste material, are also well known in the art. However, each blade element is independently operated and no provision is made to distribute the centrifugal force among a plurality of blade elements to improve the reliability of their operation and to avoid sticking.

What is needed then is a configuration for an impeller which develops high power and torque, which may be started regardless of which position it is initially disposed, which is self-cleaning, has a low frictional force and is of simple and rugged design. What is further needed is an arrangement and configuration for abrasive blade elements by which the effective force available is uniformly distributed in order to increase the reliability of operation of the blades.

BRIEF SUMMARY OF THE INVENTION

The present invention is a water actuated disposer which comprises a separable housing, a rotatable abrasion disc, at least one blade element, a rotatable drive shaft, an impeller, a water jet and an outlet port. The housing includes an upper, or grinding chamber in fluid communication with a lower, or impeller chamber through a central chamber. The rotatable abrasion disc may be disposed in the lower portion of the grinding chamber and at least one blade element is coupled to the abrasion disc. The rotatable drive shaft is coupled to the disc and extends into the impeller chamber of the housing. The impeller is similarly coupled to the drive shaft and is rotatably disposed in the impeller chamber. The impeller may also have a disc shape with a plurality of projection disposed on the periphery of the impeller. Finally, the outlet port communicates with the impeller chamber to provide a means for removal of spent water and comminuted waste.

The present invention is more particularly characterized in that the projections on the impeller have planar surfaces generally aligned with the radius of the disc-shaped impeller. A plurality of abrasion blade elements may be coupled to the abrasion disc and may be operable by means of centrifugal force or fixed to the disc. The moment of inertia and balance of the impellers are chosen to approximate a pre-selected value in order to optomize the power, torque and rotational acceleration achievable by the impeller and other active elements within the disposer.

In a more preferred embodiment, the water powered garbage disposer of the present invention comprises a housing made of upper central and lower selectively interconnected sections, the upper and central sections, when coupled together, defining a grinding chamber and the central and lower sections, when coupled together defining an impeller section. The upper section has a plurality of grinding and cutting means disposed on the interior surface thereof such that as the garbage is caused to impinge on such means, it is quickly shredded into a fine form that can be easily caused to flow out of the disposer.

The central section has a shaft spider disposed therein with a rotatable shaft axially disposed in the shaft spider. The shaft has an abrasive disc coupled adjacent to one end thereof and extends into the grinding chamber. A disc impeller is coupled adjacent the other end of the shaft and extends into the impeller chamber. The abrasion disc also has a plurality of cutting and grinding means disposed on a surface thereof such that, as the abrasion disc is caused to rotate, garbage and the like is quickly shredded into a more easily removed form. In order to encourage this grinding action, two blade elements may be pivotably coupled to the abrasion disc so as to move from a retracted position generally flush with the surface of the abrasion disc, to an extended position above said surface and into the grinding chamber. As discussed hereinabove, a disc impeller is coupled to the other end of the shaft and has a plurality of projections disposed adjacent the periphery thereof. Each of these projections may have a substantially planar face disposed generally along the radius of the disc impeller or at an acute angle to the radius remote from the disc center.

The lower section has an inlet jet nozzle for directing a stream of water against the projections on the disc impeller, as well as an outlet through which water and the now finely ground garbage may exit.

Water entering into the impeller chamber through the jet nozzle, impinges on the projections to cause the impeller to rotate, which in turn causes the abrasion disc to rotate in the grinding chamber, bringing the cutting and grinding means of the disc into contact with the garbage. When a predetermined centrifugal force of the abrasion disc is achieved in the one embodiment, the abrasive blades pivot to a position above the surface of the abrasion disc, thereby substantially improving the ability of the garbage disposer to grind up even those foods which have natural resistance to grinding.

The water jet nozzle in the preferred embodiments is coupled to the lower or impeller chamber, but also includes a rinse conduit which extends upwardly so as to communicate with the upper grinding chamber. In this manner, as water from the nozzle enters the lower chamber, a portion thereof is directed to the upper grinding chamber. This additional water helps to flush out the upper chamber and also helps encourage the removal of garbage waste therefrom in a generally downward direction so that the waste eventually flows into the lower chamber. The jet stream, after it has impinged on the projections of the impeller disc, further dilutes the garbage in the lower chamber and causes it to exit out of an outlet port of the lower chamber.

Thus, the present invention achieves substantial advantages over the prior art garbage disposers. Conventional garbage disposers powered by electricity require substantial inputs of energy in use. The present invention provides apparatus for grinding garbage waste which uses substantially less electrical energy and yet achieves the same desired result as that achieved by well known electric garbage disposers. Moreover, the present invention contains few moving parts and no electric motor, thus rendering the present invention relatively inexpensive to produce and to maintain. Finally, because the present invention operates using a flow of water as the power source, and further because the present invention contains few moving parts, jamming of the garbage disposer of the present invention is substantially prevented.

The problem with jamming was one of the most significant problems associated with past garbage disposers, both those that were powered by electricity and by other means. The present invention, which utilizes a unique configuration of grinding and cutting means in a relatively simple and straightforward design, achieves the necessary cutting action without increasing the likelihood of jamming which increases through the use of a more complicated structure. Even if jamming should occur because of the use of materials which should not be ground in any disposer, the present invention contemplates the use of an easily assembled and disassembled three part construction, so that the assembly can be easily disassembled, the jamming material removed, and then reassembled without the need for expensive tools and labor.

The novel features which are characteristic of the invention, both as to its organization and methods of operation, together with further objectives and advantages thereof, are better understood from the following description considered in connection with the accompanying drawing in which presently preferred embodiments of the invention are illustrated by way of example. It is to be understood, however, that the drawing is for the purpose of illustration and description only, and are not intended as a definition of the limits of the invention.

BRIEF DESCRIPTION OF THE DRAWING

FIG. 14 is a sectional plan view taken along line 14—14 of FIG. 13;

FIG. 15 is a sectional bottom plan view taken along line 15—15 of FIG. 13;

FIG. 16 is a fragmentary sectional elevation taken along line 16—16 of FIG. 15;

DETAILED DESCRIPTION OF THE PREFERRED EMBODIMENTS

The present invention may be embodied in a water powered or hydraulically actuated garbage disposer, which is characterized by jam-free starting, high initial angular acceleration, high torque and reliable operation. These advantages of the present invention are achieved by means of an improved impeller and impeller assembly in combination with a unique coupling and distribution of centrifugal force among a plurality of abrasion blade elements both static and mobile. One embodiment of the present invention, as well as the structural and functional relationships and operational mode, may be better understood by viewing FIGS. 1–4 in light of the accompanying description.

Figure 1:
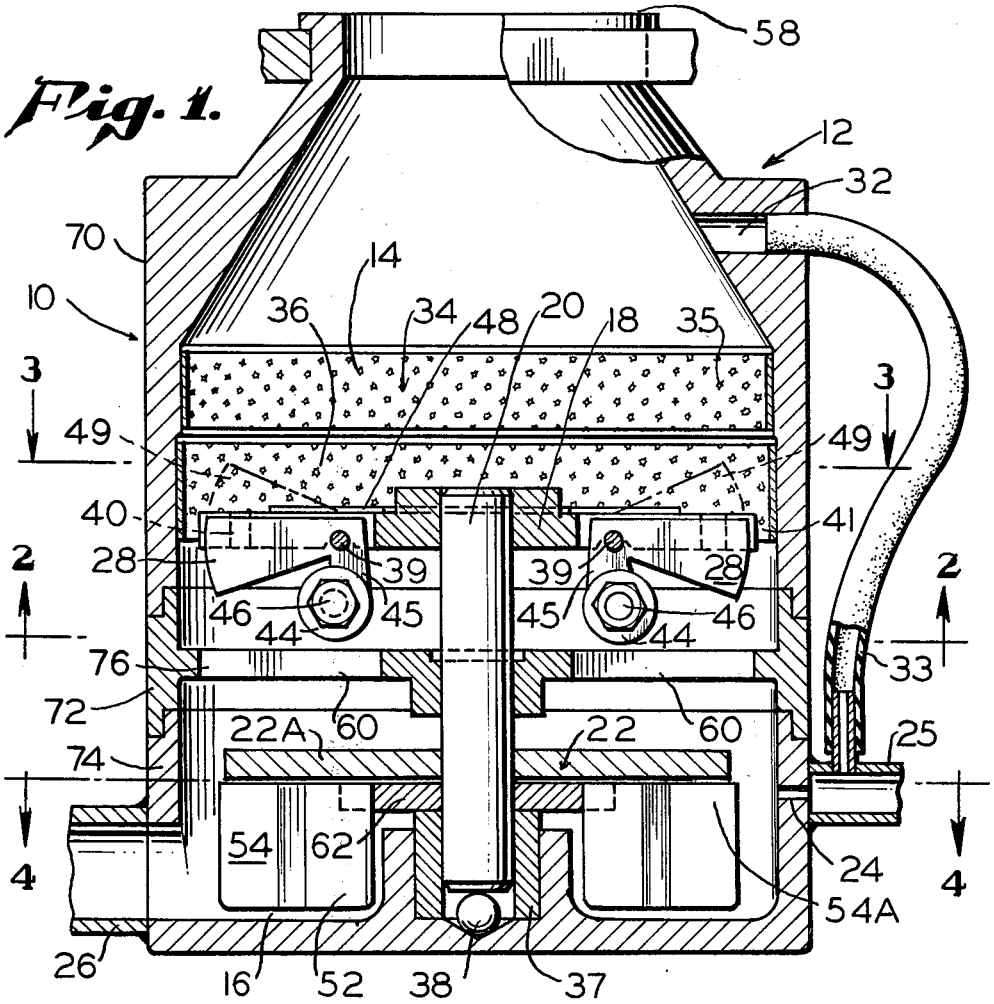
FIG. 1 is a cross-sectional view of the assembled disposal.

The overall structure of a disposer 10 is illustrated in a cross-sectional view in FIG. 1. Disposer 10 may comprise a housing 12 which includes an upper or grinding chamber 14 and a lower or impeller chamber 16. A rotatable abrasion disc 18 in grinding chamber 14 is coupled to a drive shaft 20. Drive shaft 20 extends into lower chamber 16 and is coupled to an impeller 22, driven by a high velocity stream of water directed towards the impeller periphery by means of an inlet water jet 24 fed by a supply conduit 25. Spent water, including water carrying comminuted waste, is removed from disposer 10 by means of an outlet port 26 which communicates with lower chamber 16. It is, of course, to be understood that in some embodiments outlet port 26 may directly communicate with upper chamber 14 and may only indirectly communicate with lower chamber 16.

Abrasion disc 18 has a plurality of abrasive blades 28 rotatably coupled thereto. Blades 28 are centrifugally operated. In the embodiment illustrated, upper chamber 14 may also include an additional water inlet port 32 coupled to inlet water jet 24 by a conduit 33, and wall-mounted grinding means 34. Grinding means 34 includes one or more ridged projections 35 extending along the interior wall of upper chamber 14 and grinding bands or rings 36 which circumscribes abrasion disc 18. A plurality of projections and indentations may be made upon rings 36 which aid in the comminution of large waste particles in cooperation with the operation of blades 28. Any grinding means well known to the art may be employed in combination with abrasive blades 28 to improve the comminuting action and jam-free operation of disposer 10. Finally, it should be noted that drive shaft 20 may extend within lower chamber 16 and rotate within bushing 37. Any bearing surface well known to the art may be employed, but it has been observed that ball bearings are particularly well adapted to thrust and shaft 20 may rest upon a ball and in the present invention in order to provide a low friction and rotatable coupling between drive shaft 20 and housing 12.

Figure 2:
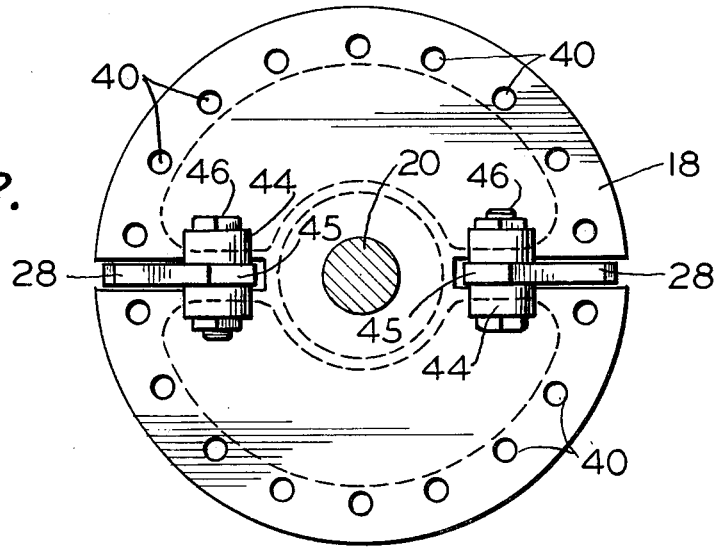
FIG. 2 is a plan view taken through section 2—2 of FIG. 1 showing the blade element and the base plate.

Greater detail of abrasion disc 18 may be seen in plan view FIG. 2. Disc 18 is axially centered with respect to the center of housing 12, and is supported by drive shaft 20. In the embodiment of FIG. 1, two abrasive blades 28 are shown as rotatably coupled to abrasion disc 18 by transverse pins 39. A plurality of openings 40 may be disposed in disc 18 to provide a means whereby water and small comminuted particles of waste may be disposed by gravity flow within upper chamber 14 to a position beneath disc 18. Smaller particles of waste may also flow downward through housing 12 through annular clearances 41 provided between lower ring 36 and blades 28 and disc 18.

Blades 28 are shown in FIGS. 1 and 2 as inverted L-shaped plates. In the embodiment illustrated, each abrasive blade 28 is rotatably coupled to disc 18 by means of the pin 39 disposed through blade 28 and coupled to disc 18. Any means of attachment between blade 28 and disc 18 known to the art may be employed and the means shown is to be understood as illustative only. Additionally, cylindrically shaped weights 44, as shown in FIGS. 1 and 2, may be coupled to blades 28 at the lower end of blade arm 45 by bolts 46 in order to enhance the centrifugal force exerted on the blades when disc 18 is rotated. It should be understood that many embodiments and shapes are possible for centrifugal blades 28 and that the scope of the present invention is not to be limited by the embodiment used as an example.

Figure 3:
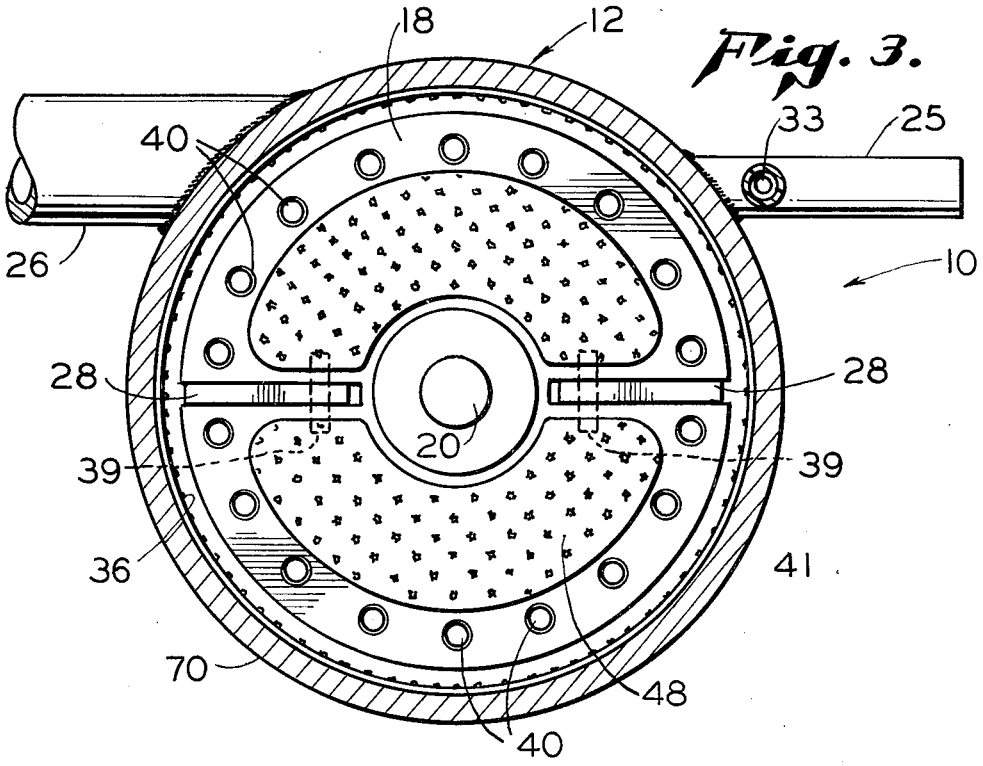
FIG. 3 is a plan view taken through section 3—3 of FIG. 1 showing the underside of the base plate.

FIG. 3 illustrates in greater detail one embodiment by which blades 28 may be coupled. FIG. 3 is a plan view of the topside of abrasion disc 18 with upper chamber 14 removed. As discussed above, the lower extending arm 45 of blade 28 may include a bolt 46 to which the weights 44 are coupled. In addition, a rigid linkage (not shown) may be rotatably coupled to pin 39 to a pair of blades which have the same sense of rotation about their respective pins 39. Therefore, when one blade 28 is urged upward into an operative position by means of centrifugal force acting on the mass of the blade and weights 44, the same centrifugal force is transmitted to the paired blade 28 through the linkage. Similarly, a second of the paired blades is capable of exerting a similar force on the first blade 28. Thus, if the rotation of either blade 28 should be impeded for any reason, such as the degradation of the pivot surface about pin 39 or the lodging of a waste particle between blade 28 and an adjacent surface, the centrifugal force exerted upon the combined mass of the paired blades will be available to either blade 28. FIG. 3 also indicates that cutting and grinding means 34 in the form of half discs 48 may be disposed on the surface of the disc 18 which extend into the upper or grinding chamber 14. As discussed herein, by providing the disc 18 with additional grinding and cutting means 48, the necessary grinding action is encouraged.

It may also be desirable to have a means for urging abrasive blades 28 from the operable position shown in FIG. 1 in dotted lines 49, where they extend above disc 18, to an inoperable position wherein blades 28 are flush with the top surface of disc 18. A spring (not shown) may be coupled to bolts 46, one end of each spring coupled to a bolt of a blade 28 in the opposing pairs of blade elements. As blades 28 rotate into the operable position, the displacement between each of these blades changes. A spring coupled between these respective blades therefore is extended or retracted and remains so as long as blades 28 remain in the operable or partially operable position. As the angular rate of rotation at disc 18 decreases, the centrifugal force applied to blades 28 decreases. Eventually the spring force provided by said spring overcomes the centrifugal force tending to keep the respective blade elements apart and blades 28 will return toward the inoperable position.

Whenever disc 18 is at rest, gravity returns blades 28 to the inoperable position where they are flush with the upper surface of disc 18. This feature is particularly important in regard to restarting disposer 10. Typically, the user disposes waste material within grinding chamber 14, which waste rests upon the upper surfaces of blades 28 and disc 18. If blades 28 were allowed to remain in the operable position they would provide substantial inertial and frictional force by means impact with the waste materials disposed in grinding chamber 14 during the start-up period of disposer 10. The angular momentum of the rotating blades within disposer 10 is initially very low until the rate of rotation of impeller 22 has achieved a pre-selected magnitude. When impeller 22 and disc 18 have obtained the desired rate of rotation, blades 28 begin to rise upward and move into the operable position. At this point, sufficient angular momentum has been generated in the rotating elements such that the frictional forces and impacts created by the waste material do not jam or destroy the overall operability of disposer 10. However before that time, blades 28 remain in the in-operable or flush position, such as is shown in plan view in FIG. 3 thereby minimizing the impact resistance with waste material disposed in upper grinding chamber 14.

The angular rate and momentum of impeller 22 and base plate 18 increases as water impinges from jet 24 until a pre-selected magnitude is reached at which point blades 28 begin to move into the operable position and exert a comminuting force against waste materials disposed in chamber 14. It may be readily appreciated in view of the above that the pre-selected angular rate and moment of inertia is fixed by the masses of blades 28, weights 44, and the overall geometry of the device. However, given a fixed geometry the point at which blades 28 begin to move towards the operable position can be determined solely by the mass of weights 44.

Figure 4:
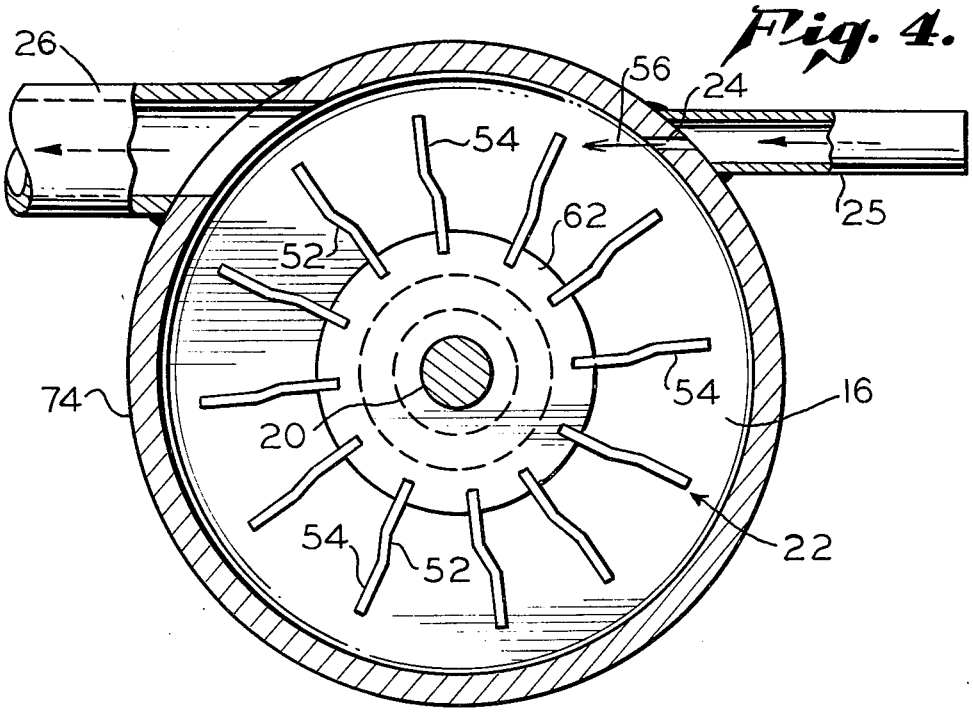
FIG. 4 is a plan view taken through section 4—4 of FIG. 1 showing the impeller, its projections, and its relationship with respect to the water jet and outlet port.

The driving force of disposer 10 is provided by impeller 22 disposed within lower chamber 16. Details of impeller 22 may be seen in FIGS. 1 and 4. Impeller 22 is a disc shaped wheel having a plurality of fin-like projections 52 disposed on its periphery. In the embodiment of FIG. 1, fin-like projections 52 have a planar surface 54 aligned generally along a radius of disc-shaped impeller 22 best seen in FIG. 4. Water jet 24 is disposed in lower or impeller chamber 16 such that the center of the stream of high velocity water from jet 24 is directed to the upper portion 54A of planar surface 54. Thus, a stream 56 of water impinges upon planar surface 54 of each projection 52 at least at that point where planar surface 54 makes a substantially perpendicular angle with the direction of stream 56. ;p In the illustrated embodiment twelve projections 52 are diposed along the bottom periphery of an impeller disc 22A which is approximately 5 to 6 inches in diameter. As shown in FIG. 4, water stream 56 impinges at least partially upon portions of a plurality of planar surfaces 54 of projections 52. Thus, at any instant and at any position of impeller 22, one or more projections 52 are subjected to the impinging force of the water stream. Regardless of the position of impeller 22, whenever the water stream is initiated, it exerts a force on impeller 22 which tends to rotate it and drive shaft 20. It may, of course, be appreciated that the number of projections 52 which are subjected to the impinging force stream 56 may be varied according to the overall dimensions of planar surface 54, the number of projections 52 on the periphery of impeller 22, and the width of the water stream.

Impeller 22 may be mounted on an impeller base plate 62 shown in FIGS. 1 and 4 which has a diameter less than that of impeller disc 22A. In this case, impeller disc 22A serves as a splash plate to partially confine the stream to projections 52. The disc and plate may be keyed, bolted or press-fitted to the shaft.

Typically, impeller 22 is a weighted disc shaped wheel which is normally balanced with respect to the center of drive shaft 20. However, various minor adjustments may be made in conventional fashion in the weight distribution of impeller 22 to compensate for off-center weight eccentricities of the rotational assembly, which includes impeller 22, drive shaft 20, abrasion disc 18, blades 28 and their associated structural elements. The amount of mass and weight distribution between impeller 22 and the remaining rotational elements of disposer 10 is critical to the smooth and efficient operation of the present invention and impeller 22 may be fabricated of a lead bearing alloy or other heavy metal so that a substantial fraction of the inertial mass of the rotation assembly is contained within the impeller. The rotational performance of the entire assembly may be determined by appropriately choosing the weight of impeller 22 and minor alterations may be made thereto by selectively adding to or drilling out selected portions. If the overall inertial mass of the rotational assembly is too small, frictional forces and impact forces from waste from within chamber 14 may very well be greater than the impact force provided by the rotation of blades 28. The rotational assembly may jam and interfere with the efficiency of comminution. On the other hand, if the angular inertial mass of impeller 22 and the rotational assembly is great, it will be difficult to achieve satisfactory angular acceleration rates or to develop the desired forces and torques required in grinding chamber 14. The appropriate mass to be used can be empirically determined in each application. In the FIG. 1 embodiment where impeller 22 has a 5 to 6 inch diameter, base plate 18 is aluminum while blade elements 28 and drive shaft 20 are of stainless steel and are configured as illustrated and have an approximate mass of three pounds.

The power, torque, and acceleration developed by disposer 10 is also dependent upon the force of the water stream defined by water jet 24. In the illustrated embodiment a pressure of 40 psi is sufficient to satisfactorily drive impeller 22 and comminute common household waste. In such a case impeller 22 reaches approximately 1,500 to 2,000 rpm. It is estimated that the power developed by impeller 22 of the specifically illustrated embodiment at 25 psi is approximately one quarter horsepower. It is to be understood however, that the mass within the rotational assembly may be arranged in other configurations, well known to the art, without departing from the scope and spirit of the present invention.

It should be noted that outlet port 26 is disposed within impeller chamber 18 approximately opposite of inlet 24. Although the direction of the stream is substantially altered by its impingement upon projections 52, the average momentum of the stream 56 carries substantially all the stream to outlet port 26. Therefore, spend water from jet 24 is substantially removed through outlet port 26 without circulating the entire circumference of lower chamber 16. The immediate removal of the driving stream from chamber 16 lessens the degree of friction exerted on impeller 22 as it rotates within chamber 16, increasing useful power available for comminuting waste within upper chamber 14.

Again referring to FIG. 1, disposer 10 has three interconnected sections, a first section 70, a second section 72, and a third section 74. It has been found that by making the instant disposer 10 with three separable but interconnectable sections, substantial advantages can be achieved both in the construction of the device in terms of making it for substantially less money, and in disassembling the same should a part need to be replaced or should jamming occur.

The first section 70 defines the upper or grinding chamber 14 with the second section 72 while the second section defines the lower or impeller chamber 16 with the third section 74. One can see that first section 70 has the cutting and grinding means 34 disposed in a circular manner on the interior wall thereof. Grinding and cutting means 34 are generally formed by forming cutting protrusions on a band or ring 36 which then can be easily fitted into the interior of section 70. In this manner, should different shaped cutting means be desirable, or should the cutting means 34 become dull, disassembly of disposer 10 can easily be achieved and the various cutting rings 36 replaced.

The second section 72 has a shaft spider 76 transversely disposed therein. The drive shaft 20 has the abrasion disc 18 disposed at one end therof so as to extend into the chamber 16, and the impeller disc 22A disposed at the other end thereof so as to extend into the lower chamber 16. As previously discussed, disc 18 has a plurality of cutting and grinding means 48 disposed on the surface thereof that extends into the chamber 16. In addition, the various blades 28 are also rotatably coupled to the disc 18 to move from a retracted position generally flush with the upper surface of the disc 18, to an extended position above the disc 18 and into the upper chamber 14. ;p At the other end of shaft 20 the impeller 22 has a plurality of projections 54 adjacent the periphery thereof. As shown in FIG. 1, these projections are disposed underneath the disc 18 and are also coupled to the impeller base plate 62 adjacent the periphery thereof. It should be noted that impeller disc 22 functions as a fly wheel in its reltionship to achieving the necessary rotation of the shaft 20 and thus the disc 18 and associated cutting means 48.

The third section 74 has the inlet jet 24 extending therethrough and the outlet port 26. The inlet jet conduit 25 forms a T adjacent third section 74 with a conduit 33 and extends upwardly to the first section 70. Port 32, which extends into the first section, thus receives water from the inlet jet 24 in order to help encourage the grinding action in the chamber 14.

In operating the disposal of the present invention, water can be caused to flow through inlet jet 24 by a variety of means such as, for example, a well known solenoid operated valve and the like. It is contemplated that such solenoid valve could be coupled to a pre-existing wall switch such that turning the switch to the on position would cause water to flow through inlet jet 24 and achieve the desired grinding action as discussed hereinabove.

An alternate embodiment of the invention is shown in FIGS. 5 through 11 wherein a disposer generally indicated by the reference character 80 has three separable sections 70A, 72A, and 74A. Each section is comparable in function to the similarly numbered sections 70, 72, 74 of the embodiment of FIG. 1 although differing a little in configuration. Section 70A has a conventional mounting collar 71 for attaching the disposer to the outlet tailstock of a conventional domicile sink. Opening 58A at the top of section 70A receives garbage and other waste from the sink. Sections 70A, 72A combine to define a chamber 73A in which waste is ground to small particles. Section 70A has an outward peripheral flange 75 which seats on a shoulder of section 72A so that the two sections may be secured together by a plurality of screws such as the screw 77. An abrasion disc 79 is rotatable within grinding chamber 73.

The abrasion disc 79 is fixed to an upper end of a shaft 20A which is journalled in a shaft spider 76A which is a part of central section 72A. A mounting bushing 81 receives the shaft and affords relatively friction free stabilization of the shaft with respect to spider 76A. The shaft continues to lower section 74A through an impeller chamber 83 defined by the bottom portion of central section 72A and lower section 74A. The two sections 72A and 74A have downward and upward collars, respectively, which with screws 85, are adapted to secure the two sections together.

Impeller chamber 83 contains an impeller 86 which is secured to the shaft by means of a mounting hub 87. The impeller, hub, and shaft may be press-fitted together. The floor of lower section 74A has a central boss 88 which contains a journal bushing 37 and a bearing ball 38 by means of which shaft 28 is secured to operate at a low friction level.

Impeller 86 has a flywheel disc 91 affixed to the upper portion of mounting hub 87. The flywheel has a shallow recess 92 in its upper surface. The depth and diameter of the recess may be altered to achieve the optimum mass for the flywheel with respect to the mass of other components of impeller 86 in the manner and for the reasons discussed with respect to the concommitant elements of the embodiment of FIG. 1. A circular plate 93 located adjacent the bottom surface of flywheel disc 91 receives a plurality of fin-like projections 52A secured in peripheral notches of plate 93 displaced from the rotational axis of shaft 20A.

Figure 11:
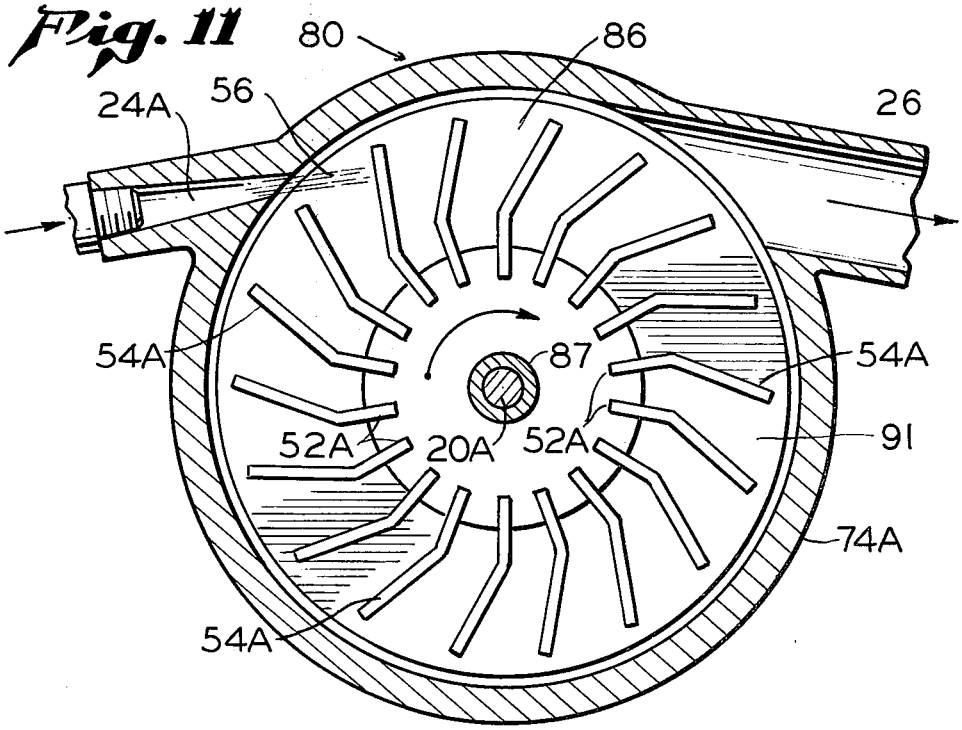
FIG. 11 is a sectional plan view taken along staggered line 11—11 of FIG. 6.

As can best be seen from FIG. 11, each fin-like projection 52A has an impact portion 54A extending outwardly from the center of plate 93 at an acute angle to the radial extent of the projection 52A. When the non-radial attitude of all of the impeller impact portions 54A is combined with the slight upward angle of water inlet jet 24A, the result is to confine the high velocity stream to the upper area of the projections adjacent the bottom surface of plate 93. This has been demonstrated to increase the efficiency and the starting torque of the impeller when compared with the configuration of the projections of the embodiment of FIG. 1.

The angle to horizontal of the axis of inlet jet 24A is on the order of five degrees. The acute angle between the extent of the projections 52A and the impact portions 54A of each projection is approximately 30 degrees.

When the jet stream 56 impacts impeller 86, shaft 20A is caused to rotate in clock-wise direction as viewed in the bottom or inverted plan view of FIG. 11. This shaft rotation in turn causes rotation of abrasion disc 79 which is secured to the upper portion of shaft 20A. Abrasion disc 79 has diametrically opposed main knives 95 each of which has a sharp leading edge curving upwardly from the disc. A first circular abrasive blade 96 outward of knives 95 extends 360° adjacent the peripheral border of the abrasion disc. A multiplicity of teeth 97 extends upwardly in on the edge of the blade, which may be seated in an annular groove of the disc 79. A plurality of concentric circular abrasive blades 98 of decreasing diameter surrounds central shaft 20A, to which the abrasion disc is fixed. Like abrasive blade 96 each of the abrasive blades 98 has a multiplicity of sharp, upwardly presented teeth 97 which encounter food waste loaded through opening 58A impinging upon abrasion disc 79. The central portion 99 of the abrasion disc has no abrasive blade. However, an assymetrical spike 101, which may be formed from an extension of shaft 20A serves to impel centrally disposed waste pieces toward the outer abrasive blades.

Since the angular rotation of the abrasion disc is at a high rate, comminuted particles sometimes tend to be centrifuged outward toward an inner wall 103 of upper section 70A within chamber 73. Therefore, a rinse spray which is indicated by broken lines 104 is provided. Instead of the outward flexible conduit 33 of the FIG. 1 embodiment, an inner conduit 105 is provided, linked with water inlet jet 24A through a series of peripheral section bosses 106, 107 and 108 on the outer walls of the sections 74A, 72A and 70A, respectively. Conduit 105 terminates in a horizontal inlet 32 which directs water from jet 24A into an annulus 109 defined between inner wall 103 of section 70A and a semi-toroidal ring 110 which may be a split ring secured in spaced concentric wall grooves 111, 112 such that it forms a channel around the inner periphery of section 70A above abrasion disc 79. Perforations 114 and 115 in the toroidal ring direct the spray as may be needed. By using an encased conduit 105 accidental severing of the conduit is precluded.

To insure against leakage and pressure loss an O-ring 116 is disposed at each juncture of the sections around the conduit at the joints of the peripheral section bosses.

Figure 5:
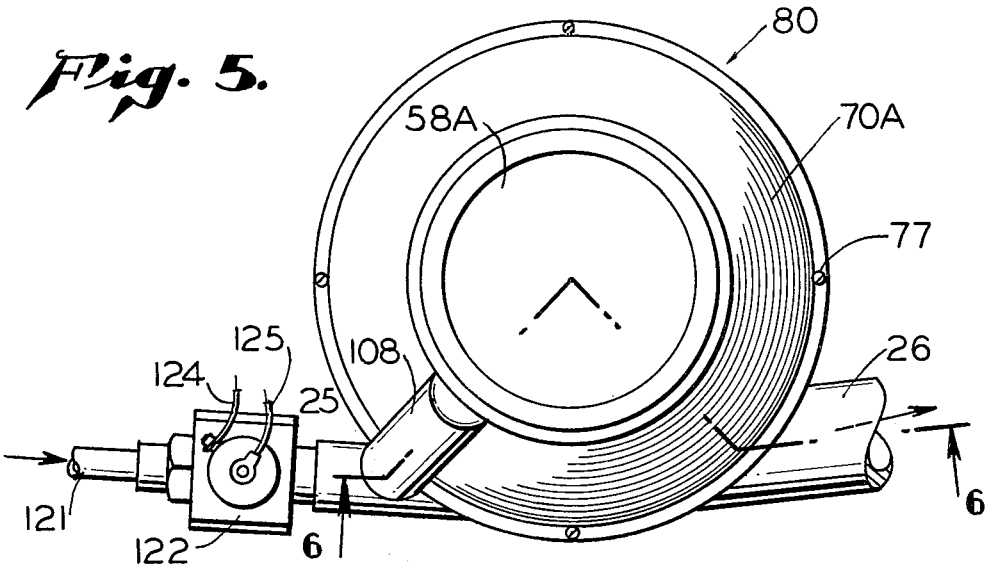
FIG. 5 is a plan view to a reduced scale of an alternate embodiment of the invention.
Figure 6:
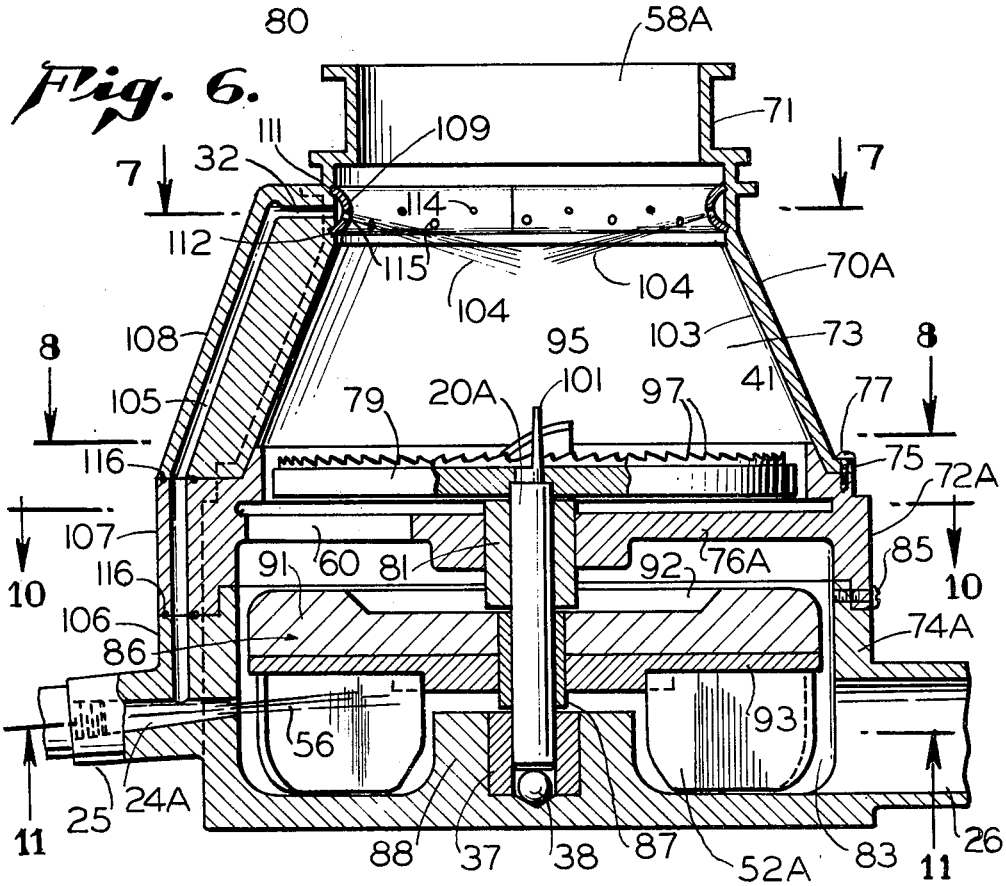
FIG. 6 is a fragmentary sectional elevation taken along staggered line 6—6 of FIG. 5.
Figure 7:
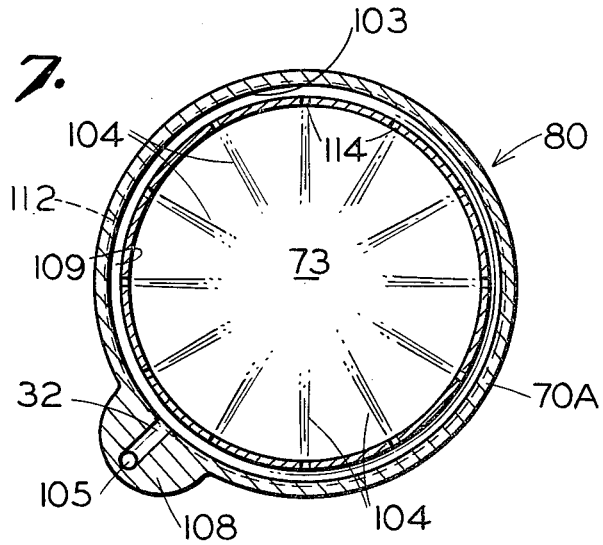
FIG. 7 is a sectional plan view to a reduced scale taken along line 7—7 of FIG. 6.
Figure 9:
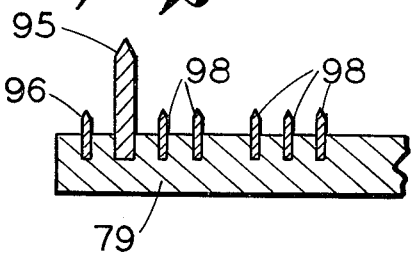
FIG. 9 is a fragmentary sectional elevation of abrasion blades taken along line 9—9 of FIG. 8.
Figure 8:
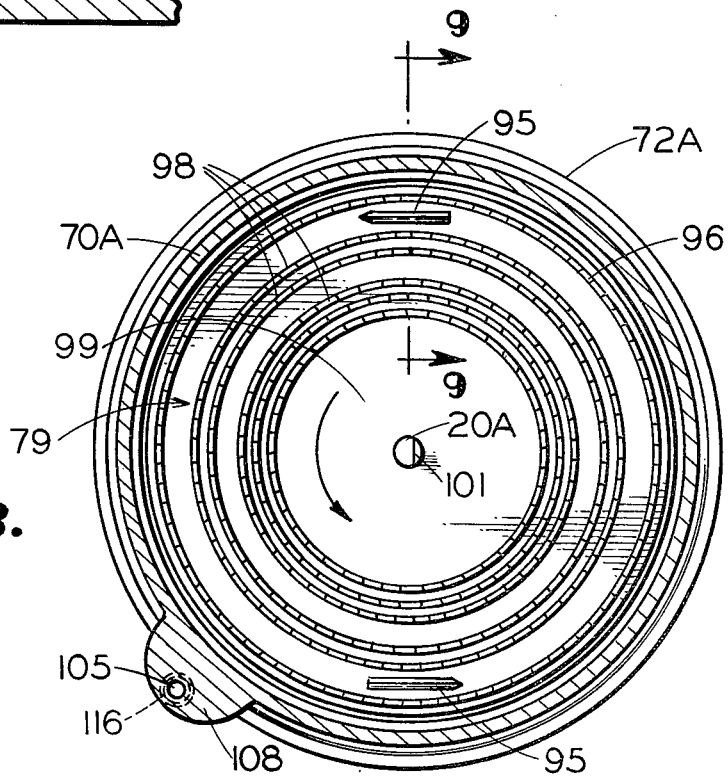
FIG. 8 is a sectional plan view taken along line 8—8 of FIG. 6.
Figure 10:
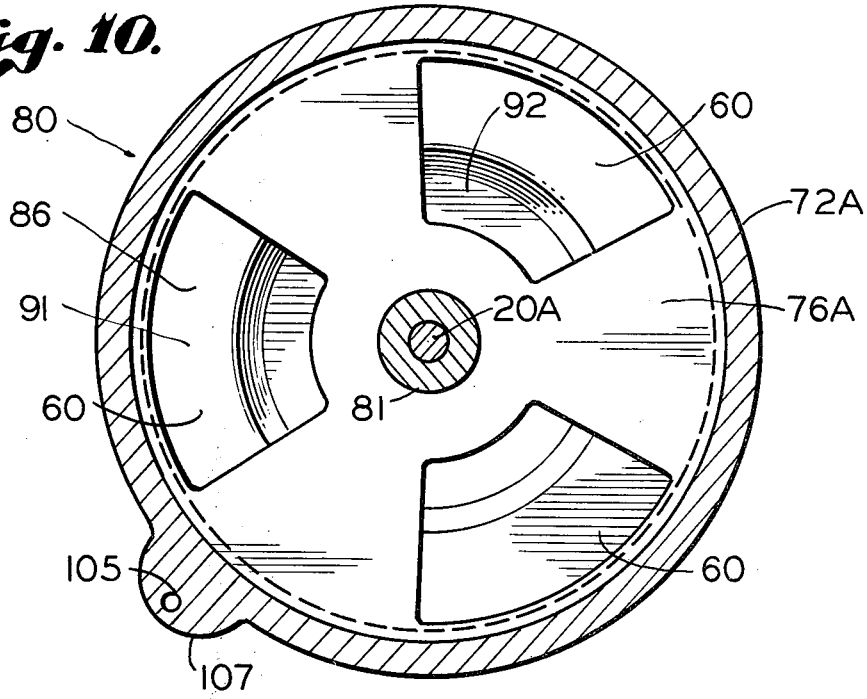
FIG. 10 is a sectional plan view taken along line 10—10 of FIG. 6.

As in the previously described embodiment the flow of water to inlet jet 24A may be controlled either manually or electrically. In the embodiment of FIG. 5 a flexible conduit 122 for water connects through an electrically controlled soenoid valve 122 to the conduit 25 with which the inlet jet 24A is connected. Electrical leads 124 and 125 of the solenoid may be conventionally wired to a wall switch or other convenient switch for ease of instituting water flow into into the impeller chamber which in turn causes accelerating rotation of impeller 86, driving abrasion disc 79 to sbrade and shred the coarse garbage or waste that was loaded into disposer through opening 58A into small particles.

Such comminuted waste is washed or impelled by gravity through an annular clearance 41 between the periphery of the abrasion disc and the inner wall of section 72A into the impeller chamber, and also down through openings 60 of shaft spider 76A. Preferably water outlet 26 is located less than 180° of impeller rotation from inlet jet 24A such that spent water from the jet falls away from the impeller and helps carry waste through outlet 26 and at the same time falls away from interfering contact with the impeller projections, reducing friction and turbulence drag on the impeller.

Figure 19:
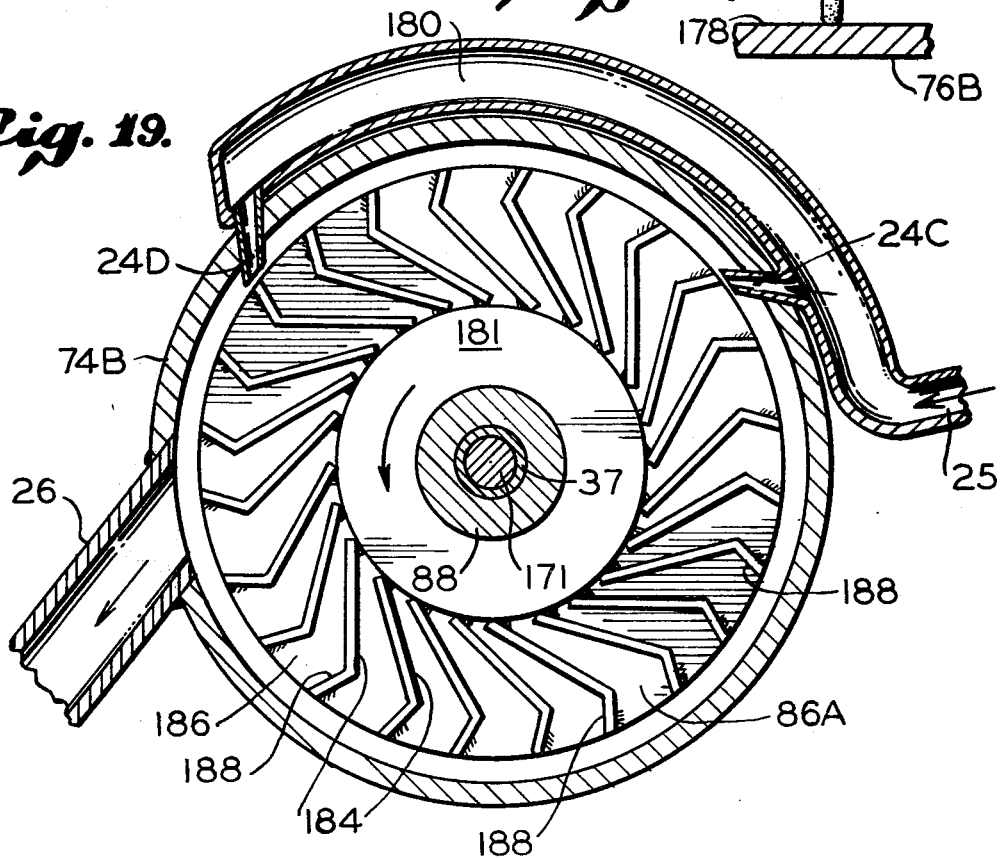
FIG. 19 is a sectional plan view taken along line 19—19 of FIG. 13.

The general organization of the alternate embodiments of FIGS. 12 through 18 and FIG. 19 is similar to the embodiment of FIG. 5 except that in FIG. 19 the disposer has two water jets. A disposer 130 is defined by an upper housing section 70B, a central housing section 72B and a lower housing section 74B, each section being a thin-walled hollow structure defining inner, substantially circular, chambers. Sections 70B and 72B combine to define a grinding chamber 141 while central section 72B and lower section 74B combine to define an impeller chamber 142. The sections are easily separable with conventional hand tools. In FIG. 19 section 74B has a jet manifold with jets 24C and 24D, while the embodiment of FIG. 12 has a single water jet inlet 24B. All jets, like the embodiment of FIG. 5, may be controlled by a solenoid valve 122. The wash sprays 104 of chamber 141 are supplied through a conduit 105 passing upwardly through peripheral section bosses 131, 132, 133 from the inlet jets like the previously described embodiment. Semi-toroidal ring 110 sends the rinse water from inlet 32 throughout grinding chamber 141.

Sections 70B, 72B and 74B are separable for maintenance and unjamming if necessary. However, jamming has proved to be no problem in the disposers of the present invention due to their simplicity and power.

Figure 12:
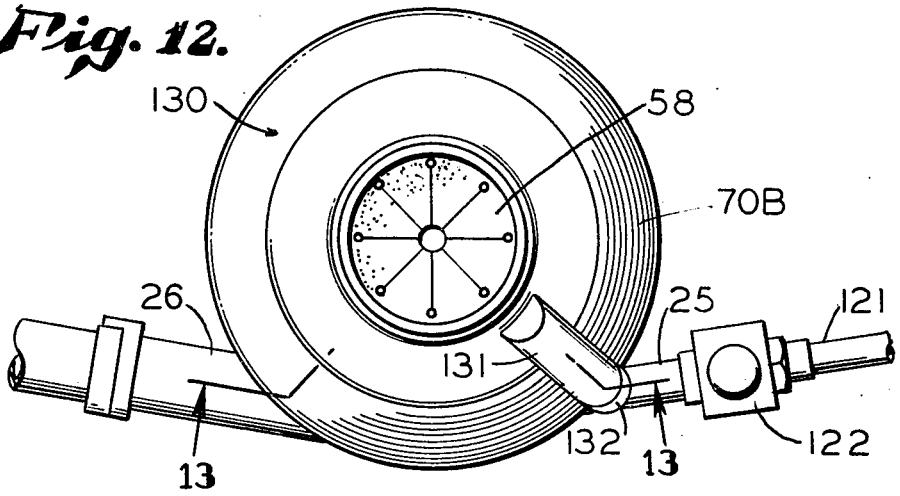
FIG. 12 is a plan view of a further alternate ambodiment of the invention to a reduced scale.

Unlike the embodiment of FIG. 5, the embodiment of FIG. 12 has abrasive blades mounted within grinding chamber 141, upwardly displaced from abrasion disc 150. Three vertical abrasion walls 151, 152 and 153 (see FIG. 15) define a restricted volume which is an irregular hexagon in horizontal cross-section. Each abrasion wall carries a plurality of skewed toothed blades 156. The skew of the blades is best evinced in the sectional view of FIG. 13 wherein the blades are shown imbedded in wall 153. The wall holds the blades in their skewed positions with respect to the horizontal plane of the abrasion disc 150 and confines the loaded-in waste to a smaller volume to intensify contact between the waste pieces and the various abrasive elements, both dynamic and static.

It has been found that by combining the disc-induced motion of the waste introduced through upper opening 58 into chamber 141 with the rotating and static blades, reduction of the waste to a water-suspendable condition is rapidly achieved. The rapid comminution of normal garbage waste is also achieved by the multiplicity of radially disposed blades which are fixed in the upper surface of abrasion disc 150.

The radially disposed blades may be 36 in number, as shown in the embodiment of FIG. 12, when combined with an abrasion disc such as disc 150, with a diameter of approximately six inches, powered by an impeller such as impeller 86A with an approximate diameter of nine inches, the total rotating weight being about nine and one-half pounds. In this physical configuration the toothed blades are distributed with long radial blades 161 extending from a central area of the disc to the extreme edge 163 of disc 150. Short blades 164 extend from edge 163 inwardly about one-half the extent of long blades 161. Stub blades 165 terminate inwardly concentrically with the short blades, but are precluded from extending to the rim 163 by a plurality of arcuately spaced ports 40 through which comminuted particles of waste may fall or be washed from the grinding chamber.

Figure 13:
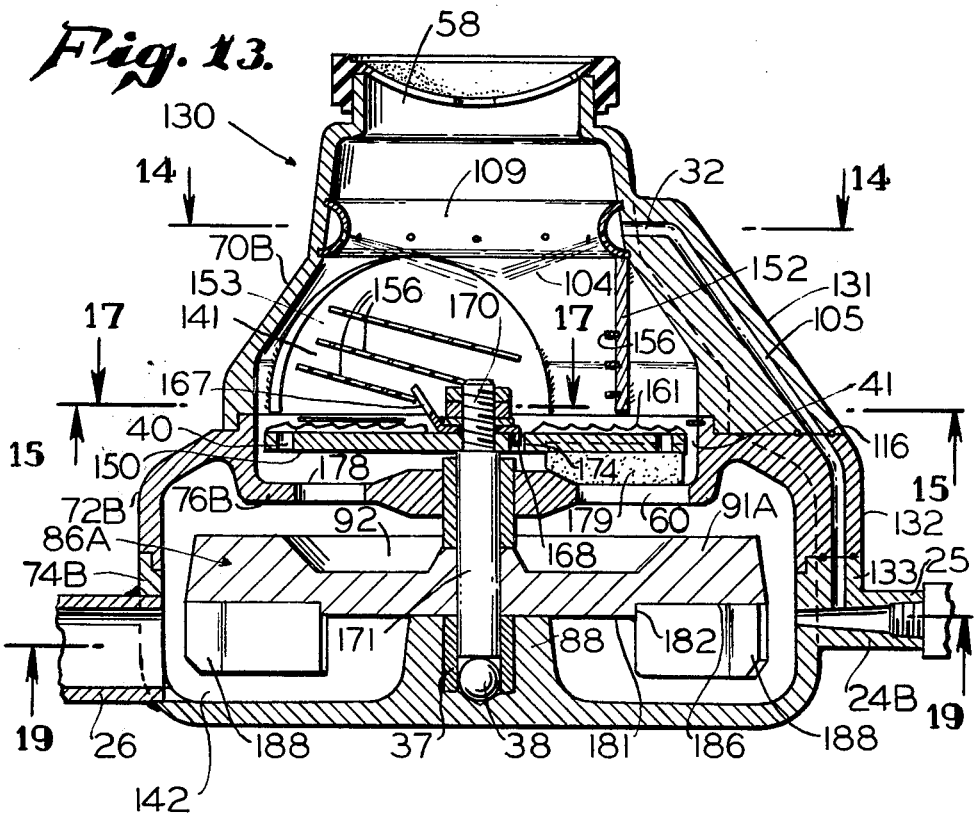
FIG. 13 is a sectional plan view of the embodiment of FIG. 12 taken along staggered line 13—13 of that Figure.
Figure 17:
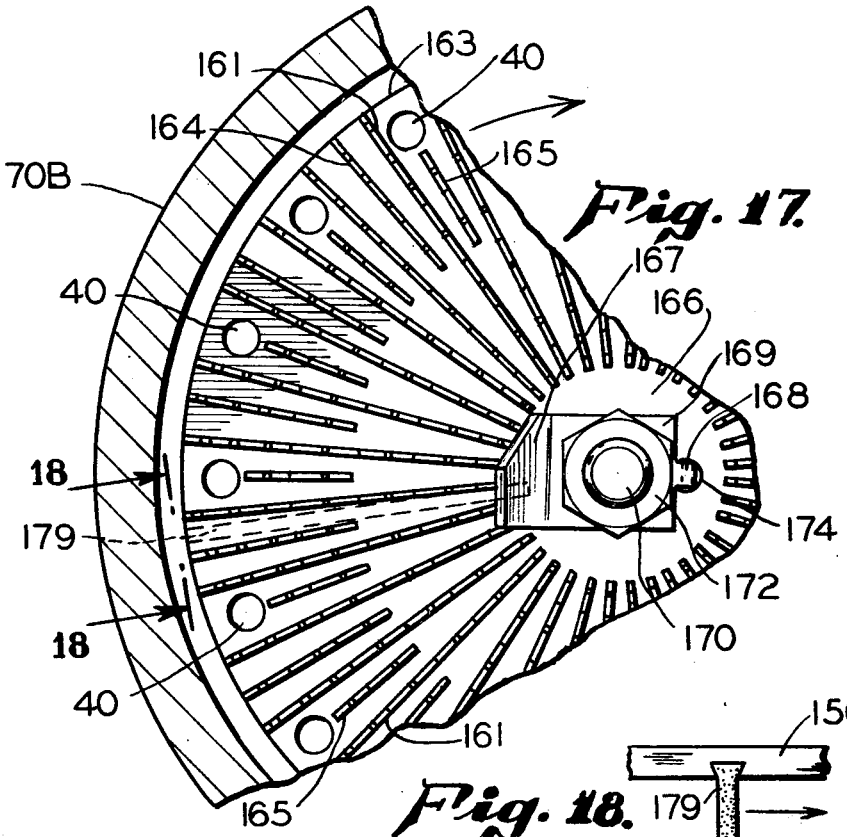
FIG. 17 is a fragmentary sectional plan view taken along line 17—17 of FIG. 13.
Figure 18:
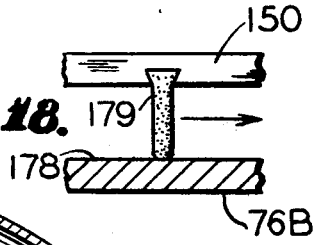
FIG. 18 is a fragmentary sectional elevation taken along line 18—18 of FIG. 17.

As can be seen from FIG. 13, each of the blades 161, 164 and 165 has upwardly directed teeth similar to those of a saw blade such that a multiplicity of sharp points is distributed about the upper surface of abrasion disc 150. Termination of long blades 161 in a central zone 166 on the abrasion disc leaves an unbladed area. Waste falling into this area encounters an eccentrically mounted, upwardly extending knife 167 that is generally L-shaped in configuration with the exception of an anchor tang 168. A knife base 169 fits about a threaded stub 170 of a central shaft 171. Lock nuts such as nut 172 engage the stub to removably secure the knife to the threaded stub and the disc to the shaft. Anchor tang 168 lodges in a small recess 174 of the disc near the shaft to insure that the knife rotates with the disc. In conventional fashion threaded stub 170 may be a left-handed thread since the rotation of the shaft, as shown in FIG. 17, is clock-wise, counter to the thread.

As is evident from FIG. 13, a peripheral clearance annulus 141 exists between edge 163 of the disc and the adjacent inner wall of housing section 70B. Finely divided particles resulting from the combined actions of the radially disposed dynamic blades and the static blades results in a rain of particles through ports 40 and the clearance annulus. Some substances in household waste have adhering qualities and thus may collect from time to time on the upper surfaces 178 of shaft spider 76B between apertures 60 of the spider. It is therefore advantageous to provide a flexible wiper 179 fixed in radial orientation to the bottom of abrasion disc 150 such that surfaces 178 are swept clean with each rotation of the abrasion disc. It is anticipated that no such wiping for the impeller recess 92 will be needed since the angular velocity of the impeller would preclude particles in the recess due to centrifugal force.

In FIG. 19 the bottom plan view describes the embodiment of FIG. 19 but also is descriptive of the embodiment of FIG. 12 except for the arcuately spaced water jets 24C, 24D and the added jet supply manifold 180, the FIG. 12 embodiment having the single jet 24B of FIG. 13. In both embodiments a lower housing section 74B contains an impeller 86A and a water jet inlet 24 extends on a chord line across the circular path of the impeller. The impeller is essentially defined by a disc-like flywheel 91A having a recess 92 in the top surface. The depth may be varied by design to adjust the mass of the flywheel. The bottom surface is stepped to define a flat shallow central boss 181 with circular shoulder 182. Downwardly extending fin-like projections 184 are fixed as by welding to the flat peripheral annulus 186 extending outwardly on the bottom surface of the flywheel from shallow boss 181. Alternatively, flywheel and projections may be integrally molded. The upper edges of the projections 184 are fixed to annulus 186 as shown in FIGS. 13 and 19. The projections of the impeller 86A of the embodiment of FIGS. 12 and 19 are not radially oriented, but rather tangent extensions from a tangent circle (not shown) slightly smaller than boss 181. An impact portion 188 of each projection extends from the outer end of each fin-like projection 184 defining with the under surface annulus 186 a water trap or impact cut. The jet streams 56 entering from water jet inlets 24 of both embodiments thus impinge upon a cup-like cavity defined horizontally by annulus 186 and vertically by the convergence of each projection 184 and each impact portion 188.

While each of the embodiments discloses an impact area of cup-like configuration, each of the impellers has a varying definition of the cavity. For instance, the impact area of the embodiment of FIG. 1 is rather an open cup since the fin-like projection is relatively planar where impacted by the stream, the "cup" being formed by the intersection of projection and bottom surface of the impeller wheel. The embodiment of FIG. 5 has an impact area which confines the stream more than does the impeller of FIG. 1, with the convergence of the impact portion and the radial portion of the projection being near the center of the impeller. The impeller configuration of FIG. 19 has proved to be extremely efficient and it is theorized that efficiency is due in part to the more closed nature of the impact area defined by the projection and its sharply angled impact area additionally confined by the proximate under surface 186 of the impeller flywheel. The added impetus from the downstream second jet inlet adds to the efficiency of the embodiment of FIG. 19, making it the best mode of practicing the invention.

The manifold 180 is preferably greater in crosssectional area than either of the water jet inlets 24C, 24D. Experience has shown that the manifold size is optimum when a multiple of the jet size. These relative proportions assure that both jets assert the same propulsive force on the impeller projections. In the illustrative embodiment the inlets have diameters of 5/32" while the manifold has a diameter of ½" I.D.

The embodiments of FIG. 1, FIG. 12 and FIG. 19 are similar in having both static and dynamic abrasion or cutting members. The circular disposition of the abrasive blades in the embodiment of FIG. 5 affords a large multiplicity of cutting points or teeth, such that the disposer operates efficiently without static abrasive blades. However, the invention does not preclude the combination in the embodiment of FIG. 5 including static blades such as those of FIGS. 1, 12 or 19.

These and other modifications within the scope of the invention will occur to those skilled in this particular art. It is therefore desired that the invention be measured by the appended claims rather than by the illustrative disclosure set forth above.

We claim:

1. A water actuated disposer for connection to a source of water under pressure and comprising a housing including an entry throat for waste, a grinding chamber, an impeller chamber, a rotatable abrasion disc in said grinding chamber, a first abrasive means secured to said abrasion disc, a rotatable drive shaft secured to said abrasion disc and extending into said impeller chamber; an impeller secured to said drive shaft and rotatably disposed in said impeller chamber, an impeller flywheel, a plurality of projections fixed to said impeller flywheel and defining therewith said impeller; a water jet inlet emerging into said impeller chamber and adapted to direct a stream of water toward said projections so as to impact said projections to induce rotary motion of said impeller, and an outlet port for water from said housing.

2. A disposer in accordance with claim 1 further comprising second abrasive means fixed in said grinding chamber to the inner walls thereof displaced from said abrasion disc.

3. A disposer in accordance with claim 1 further comprising second abrasive means in said grinding chamber displaced from said abrasion disc, mounting means for fixing said second abrasive means in said chamber, said mounting means defining an inner grinding volume smaller than said grinding chamber.

4. A disposer in accordance with claim 3 wherein each mounting means for fixing second abrasive means comprises a planar wall, each wall defining a vertical side of said inner grinding volume, and slots in each vertical side securing said second abrasive means at an angle to the plane of rotation of the abrasion disc.

5. A disposer in accordance with claim 3 further comprising an upper housing section, a lower housing section and a central housing section, the central and upper sections defining said grinding chamber and the central and lower sections defining said impeller chamber, and a second water jet inlet connected to said source of water and arcuately displaced along the wall of said lower housing section with respect to said other water jet inlet.

6. A disposer in accordance with claim 5 wherein each of said housing sections is separable from an adjacent housing section.

7. A disposer in accordance with claim 1 further comprising a rinse water distribution in said grinding chamber, a supply conduit to said rinse distributor, and means connecting said supply conduit to said water jet inlet.

8. A disposer in accordance with claim 7 wherein said supply conduit comprises an outer flexible tube.

9. A disposer in accordance with claim 7 wherein said supply conduit comprises connected peripheral bosses on the exterior of said grinding and impeller chambers, and a channel through said bosses between said water jet inlet and said rinse water distributor.

10. A disposer in accordance with claim 1 further comprising upper, central and lower separable housing sections, said upper housing section containing said entry throat and combining with said central housing section to define said grinding chamber, and said central section and said lower section combining to define said impeller chamber.

11. A disposer in accordance with claim 10 further comprising a water jet manifold, a second water jet inlet, means for connecting said manifold to said source of water under pressure, said water jet inlet and said second water jet inlet being connected to said manifold, each water jet inlet further being adapted to direct a stream of water toward said impeller projections at different peripheral locations with respect to the circle of rotation of said impeller.

12. A disposer in accordance with claim 11 wherein said manifold has a crosssectional area that is a multiple of the crosssectional area of each jet inlet.

13. A disposer in accordance with claim 1 wherein the abrasive means on said abrasion disc comprises a plurality of cutting points on the upper surface of the disc and diametrically opposed pivoted blades, a pivot pin securing each blade to swing between an inactive position flush with the upper surface of the disc and an active position above the disc surface in response to centrifugal force induced by disc rotation.

14. A disposer in accordance with claim 13 further comprising removable weights secured to said blades spaced from said pivot pin of each blade.

15. A disposer in accordance with claim 14 further comprising second abrasive means secured to the inner wall of said grinding chamber spaced from said abrasion disc.

16. A disposer in accordance with claim 14 further comprising downwardly directed ports in said abrasion disc, and a clearance annulus adapted to pass particulate matter defined by the grinding chamber inner wall and the outer periphery of said disc.

17. A disposer in accordance with claim 1 wherein each impeller projection comprises a generally planar fin aligned along a radius of said impeller and an upper edge on each projection being proximate said impeller flywheel to define a water-receiving cup therewith.

18. A disposer in accordance with claim 17 further comprising a second water jet inlet, a water jet manifold, and means connecting the manifold to said source of water under pressure.

19. A disposer in accordance with claim 1 wherein each impeller projection comprises a generally planar fin having a substantially radial central portion, an impact portion at an angle to the radial portion, and an upper edge on each fin proximate said impeller flywheel to define therewith a water cup.

20. A disposer in accordance with claim 19 further comprising a second water jet inlet, a water jet manifold, and means connecting the manifold to said source of water under pressure.

21. A disposer in accordance with claim 1 wherein each impeller projection comprises a generally planar fin having an inner projection substantially tangent to a circle intermediate the the impeller center of rotation and the impeller periphery, an impact portion at the peripheral and of the inner projection at an angle to the inner projection, said impact portion forming a dihedral with said projection to define with said flywheel a water cup.

22. A disposer in accordance with claim 21 further comprising a second water jet inlet, a water jet manifold connecting with the water jet inlets, and means connecting the manifold to said source of water under pressure.

23. A disposer in accordance with claim 22 further comprising second abrasive means in said grinding chamber displaced from said abrasion disc, and mounting means for fixing said second abrasive means in said grinding chamber, said mounting means defining an inner grinding volume smaller in horizontal crosssection than said grinding chamber.

24. A disposer in accordance with claim 23 further comprising an upper housing section, a central housing section, a lower housing section; said upper and central sections combining to define said grinding chamber and said central and lower sections combining to define said impeller section; and means releasably securing together said upper, central and lower housing sections.

25. A water actuated disposer comprising a housing including an entry throat for waste, a grinding chamber, an impeller chamber connecting to said grinding chamber, an abrasion disc rotatable in said grinding chamber, an abrasive blade secured to said abrasion disc, a rotatable drive shaft extending into said impeller chamber, a drive shaft spider with arms intermediate the abrasion disc and the impeller, a journal for said shaft central of said spider, apertures in said spider between spider arms, a flexible wiper extending from said abrasion disc and adapted to wipe said arms, means releasably securing said disc to said shaft, an impeller secured to said drive shaft and rotatably disposed in said impeller chamber, an upper housing section, a lower housing section, and a central housing section, said central and upper sections defining said grinding chamber and said central and lower sections defining said impeller chamber, the several housing sections being separable one from the other; a journal boss central of said lower housing section adapted to receive said drive shaft, a bearing ball in said boss and supporting said drive shaft; an impeller flywheel, a plurality of fin-like projections fixed to said impeller flywheel and defining therewith said impeller; a water jet inlet emerging into said impeller chamber and adapted to direct a stream of water toward said projections so as to impact said projections to induce rotary motion of said impeller, an outlet port for water from said housing; a wash water distribution ring in said grinding chamber, a wash inlet to said ring, a conduit from said wash inlet to said water jet inlet, the flow restrictor means between said conduit and said water jet inlet.

26. A disposer in accordance with claim 25 further comprising a plurality of abrasive blades secured in said grinding chamber displaced from said abrasion disc.

27. A disposer in accordance with claim 26 wherein each of said impeller projections comprises a downwardly projecting fin extending outwardly from the center of rotation of said impeller tangent to a circle intermediate said center of rotation and the periphery of said impeller, an impact portion on each fin at its outward end extending at an angle to the tangent fin to define an acute dihedral angle with said fin opening toward the water jet inlet when such projection is adjacent said inlet, said dihedral angle defining with said flywheel under surface a water cup to receive water from said jet inlet.

28. A disposer in accordance with claim 27 further comprising a plurality of abrasive blades fixed to said abrasion disc, each of the blades being radially disposed on the disc with respect to the rotation thereof and terminating inwardly short of center of rotation thereof, and a vertical knife eccentrically mounted with respect to the center of rotation of said disc within a central area devoid of blades.

29. A disposer in accordance with claim 28 further comprising a second water jet inlet, a water jet manifold connecting to the water jet inlets, and means connecting the jet manifold to the source of water under pressure.

30. A disposer in accordance with claim 27 further comprising a plurality of abrasive blades fixed to said abrasion disc, each of the blades being arcuately disposed in said disc concentric with the center of rotation of said disc, and a vertical spike eccentrically mounted with respect to the center of rotation of said disc proximate the center of said disc.

31. A disposer in accordance with claim 30 further comprising a second water jet inlet, a water jet manifold connecting to the water jet inlets, and means connecting the jet manifold to the source of water under pressure.

* * * * *